US005170514A

United States Patent [19]

Weigert

[11] Patent Number: 5,170,514

[45] Date of Patent: Dec. 15, 1992

[54] AUTOMATIC FLUID-FLOW CONTROL SYSTEM

[75] Inventor: Hans Weigert, Ridgewood, N.J.

[73] Assignee: Water-Matic Corporation, Tallman, N.Y.

[21] Appl. No.: 639,970

[22] Filed: Jan. 11, 1991

Related U.S. Application Data

[63] Continuation-in-part of Ser. No. 341,727, Apr. 21, 1989, Pat. No. 4,984,314, which is a continuation-in-part of Ser. No. 185,377, Apr. 22, 1988, Pat. No. 4,823,414, which is a continuation of Ser. No. 821,406, Jan. 22, 1986, abandoned, which is a continuation-in-part of Ser. No. 714,366, Mar. 21, 1985, abandoned.

[51] Int. Cl.[5] ..... E03D 1/00

[52] U.S. Cl. ..... 4/313; 4/379; 4/380; 4/407

[58] Field of Search ..... 4/313, 304, 623, 663, 4/407, 378, 379, 380, 387

[56] References Cited

U.S. PATENT DOCUMENTS

| | | | |
|---|---|---|---|
| 2,908,018 | 10/1959 | Petrie | 4/407 |
| 3,575,640 | 4/1971 | Ishikawa | 4/304 |
| 3,863,196 | 1/1975 | Hilles | 4/304 |
| 4,682,628 | 7/1987 | Hill | 4/623 |
| 4,707,867 | 11/1987 | Kawabe et al. | 4/313 |
| 4,742,583 | 5/1988 | Yoshida et al. | 4/313 |
| 4,756,031 | 7/1988 | Barrett | 4/407 |
| 5,003,643 | 4/1991 | Chung | 4/313 |

*Primary Examiner*—Linda J. Sholl
*Attorney, Agent, or Firm*—Klauber & Jackson

[57] ABSTRACT

A system for controlling liquid flow in bathrooms and the like in response to the presence of the user, which is configuration-adjustable to permit use in preselected sanitary applications. Light emitting means cooperate with a light sensor to detect light reflected from the user. The filtered and amplified output signal from the sensor is demodulated to provide a DC output signal. First circuit means responsive to the DC output signal actuate fluid flow for a maximum preselected period, to enable use in controlling faucet flow. Second circuit means responsive to the DC signal include means for arming the circuit following the existence of the DC output signal for a first predetermined period; and means for thereupon generating a flow control signal for a second predetermined period following extinction of the DC output signal to enable use of the system to control flushing of urinals or commodes. Third circuit means responsive to the DC output signal provide a flow control signal during the existence of said DC output signal, to enable the system to be used for control of shower flow and include means for initial adjustment of water temperature. Configuration selection means, adjustable at installation of the system, enable the installer to configure the system to provide the DC output signal to one of the first, second or third circuit means.

1 Claim, 7 Drawing Sheets

FIG. 1
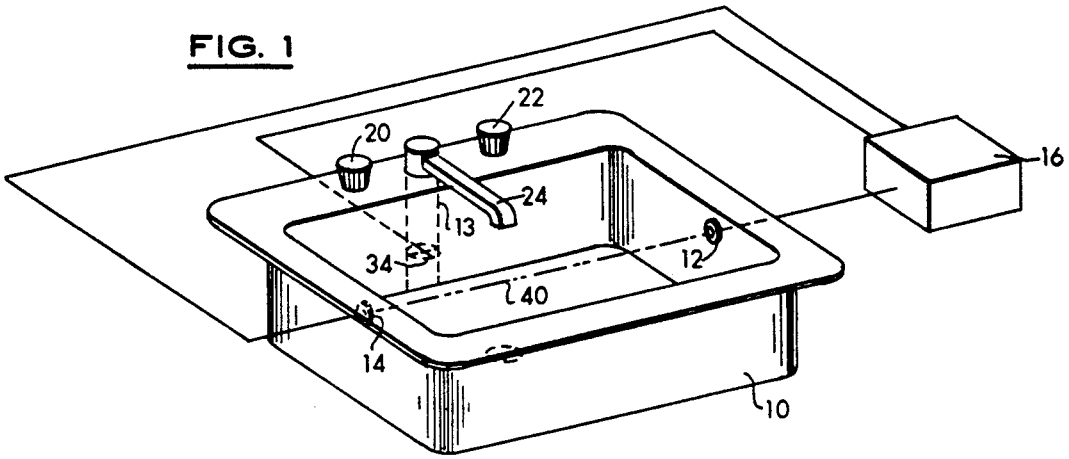
FIG. 2
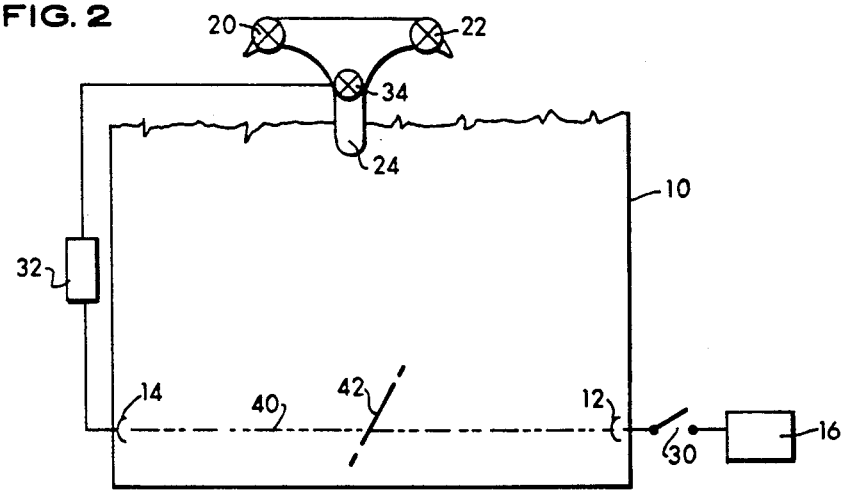
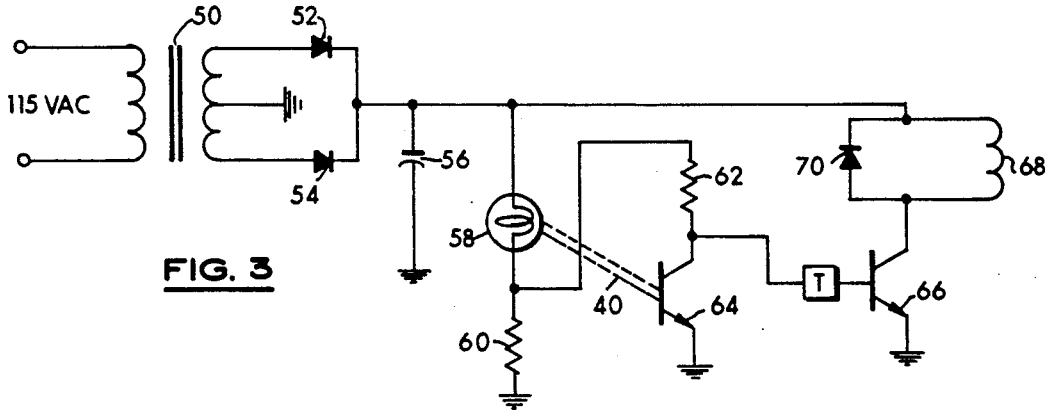
FIG. 3

AUTOMATIC FLUID-FLOW CONTROL SYSTEM

RELATED APPLICATIONS

This application is a continuation-in-part of our copending application Ser. No. 341,727, filed Apr. 21, 1989 now U.S. Pat. No. 4,984,314 issued Jan. 15, 1991. The latter is a continuation-in-part of Ser. No. 185,377 (filed Apr. 22 1988) now U.S. Pat. No. 4,823,414 issued Apr. 25, 1989, which is a continuation of Ser. No. 821,406 filed Jan. 22, 1989 now abandoned. The latter was a continuation-in-part of Ser. No. 714,366 filed Mar. 21, 1985 now abandoned.

BACKGROUND OF THE INVENTION

The present invention relates to automatically controlled fluid-flow, including faucet-sink systems, and encompasses more generally control systems for fluid flow and dispensing means. The prior art in this area is extensive, detailed and sophisticated. See for example, U.S. Pat. Nos. 3,480,787, 3,491,381, 3,575,640, 3,670,167, 2,738,448, 3,419,188, 4,309,781 and 4,373,471. The problem to which the present invention, as well as the above-cited prior art inventions pertain, is one of some importance, namely the provision of automatic means for controlling the flow of fluids such as water, with the consequent saving of energy, by providing water at sinks and similar devices only when actually needed or being used. In addition to the potential to save millions of gallons of water a day, the energy savings provided in the reduction of the amount of water required to be heated to desired temperatures is manifest, as is the savings in oil, gas and electrical energy utilized to heat the water.

A brief description of a number of the previously mentioned prior art will now be given.

Bokser, U.S. Pat. No. 2,738,488 discloses a system, for automatically flushing a toilet, whereby a user who either sits on a toilet or approaches a urinal breaks a light beam path to a photosensor, whereby the system is placed into a first condition for detecting restoration of the light beam to the photosensor when the user leaves the urinal or toilet. When the latter occurs, the system responds by going into a second condition for operating a valve for a predetermined period of time to flush the toilet or urinal, and thereafter await the next user.

Johansen, U.S. Pat. No. 3,480,787, in one embodiment teaches the application of a light transmitter 28 juxtaposed to a light sensor 29 at a level higher than a nozzle 30 and at a slight distance to its side of the vertical axis of the nozzle. The principal focus of the transmitter 28 and sensor 29 coincide at a point 31 (see FIG. 3) in a region at a level below the outlet of the faucet and laterally in relation to a vertical axis of the faucet. When a "user's" hands are placed below the faucet 30, light from transmitter 28 is reflected from the bands to the receiver 29, whereby a control circuit 25 responds to the detected reflected light for turning on a solenoid valve 21 to permit water to flow from faucet 30, when the hands are removed from the sink, light is no longer reflected to the receiver 29, and in response, control circuit 25 operates to turn off valve 21.

Cathcart, U.S. Pat. No. 3,491,381 discloses a system controlling the flow of water into a sink including an electric lamp mounted on one side of the sink and a photosensor on the opposite side for detecting a light beam from the lamp along a beam path disposed in front of the water path in juxtaposition thereto. When a user puts his hands into the expected water path, the light beam is broken, and the system responds by operating a solenoid valve to turn on the flow of water. A fail safe feature for preventing water flow if the lamp 18 failed, includes a resistive heater 38 in series with the lamp 18 for heating a bimetallic switch 40, 41. If the lamp 18 fails, power to heater 38 is interrupted, causing the bimetallic switch 40, 41 to cool and open its contacts, thereby preventing the system from turning on the solenoid valve. However, if the contacts 40, 41 in time become "pressed together" due to current transients, the fail safe feature will be rendered inoperative. Also, no protection exists against a vandal leaving an object between the lamp and photosensor to break the light beam, causing water to run continuously.

Ishikawa, U.S. Pat. No. 3,575,640 teaches an automatic water supply ststem including a capacity sensitive antenna for sensing the approach of a user to produce a valve actuator, signal for operating an electromagnetic valve to turn on a flow of water in a sink or urinal. A timer and delay circuit are included to shut off the water flow after a predetermined period of time.

Forbes, U.S. Pat. No. 3,670,167 discloses a system responsive to a decrease in the level of light supplied to one or two photocells as a result of a user approaching a wash basin, whereby the system responds by turning on a solenoid valve to initiate the flow of water into a basin. No provision is made for protecting against vandals leaving an object near the sink for making water run continuously into the sink. Also, although a user may not require water flow into the sinks, when his hands are away from the sink, water will continue to flow as long as the user or a non-user is close to the sink.

Lissau, U.S. Pat. No. 4,309,781 teaches a system for automatically flushing a urinal. The system includes a sensor assembly 10 consisting of a housing 12 enclosing an LED light source juxtaposed to a photosensor. A dark red filter is mounted in front of the LED and photosensor for reducing detection of ambient light reflections. The housing is mounted slightly above and behind the urinal. The LED 44 is excited by an oscillator 52 of fixed frequency. A user approaching the urinal causes infrared light from LED 44 to be reflected to photosensor 46. The output signal from the photodiode is connected to an amplifier 54 which is strobed by the signal from oscillator 52, for detecting only signals having the same frequency as light emitted from LED 44. The amplifier output signal triggers a timing circuit 58, which operates to turn on a solenoid valve 14, 161 when a user leaves the vicinity of the urinal, provided the user had remained in the vicinity of the urinal for at least the time period of timing circuit 58. The valve 16 is only turned on for a brief period of time, sufficient to flush the urinal 22.

Hill, U.S. Pat. No. 4,682,628 discloses a sensing and valve operating mechanism for remotely controlling a faucet which can be used with an anti-scald faucet valve and can be provided on a faucet by a kit. The mechanism senses the presence of an object near a faucet outlet, energizes a solenoid in response to the presence of an object, and calculates the time when the solenoid is energized. Energy is removed from the solenoid after a predetermined time interval notwithstanding that the presence of an object is still being sensed. The solenoid cannot be reenergized until after the object is removed from near the faucet outlet.

Notwithstanding the importance of the present problem, both as an individual matter and as a matter of national public interest, the sophisticated prior art devices cited above—which demonstrate and teach numerous alternatives for applying various electrical control systems to the flow of water and similar fluids—have in each case, various deficiencies. Some of the systems are either overly complex, or of a design that presents reliability problems. Also, certain of the above noted prior art, does not make adequate provision for the failure of the light source in a light source-photosensor pair, nor for the accidental or deliberate obscuring of the light source in a manner which would produce a wasteful flow of water, and waste of energy, or an overflowing of the sink.

OBJECTS OF THE INVENTION

Accordingly, it is an object of the present invention to provide a new, unobvious, and highly effective and reliable device, design and method, which overcomes the deficiencies of the prior art as described above.

A further object of the invention, is to provide a system for controlling liquid flow in bathrooms and the like in response to the presence of the user, which is configuration adjustable by the installer of same to permit a plurality of preselected sanitary applications.

Other objects and a fuller understanding of the present invention may be had by referring to the following description and claims, taken in conjunction with the accompanying drawings.

SUMMARY OF INVENTION

In accordance with the present invention, the foregoing objects, and others as will become apparent in the course of the present specification, are achieved in a system for controlling liquid flow in bathrooms and the like in response to the presence of the user, which is configuration adjustable by the installer of same to permit a plurality of preselected sanitary applications.

In a preferred embodiment, the said system may comprise light emitting means positioned for emitting a light beam of predetermined spectrum and frequency for illuminating a zone interceptable by said user; light sensor means juxtaposed to said light emitting means for detecting reflected light beams originating from said light emitting means and reflected back from said user, the light sensor means providing a low level output signal in response to said reflected light beams; high-Q filter means tuned to the frequency of said light beams, receptive of said low level output signal from said light sensor means, for filtering out unwanted signals and "noise" from said output signals; variable gain amplifier means for both amplifying the filtered signal from the high-Q filter and setting the sensitivity of said system; and detector means receptive of an output signal from the amplifier means for rectifying or demodulating the same, to provide a DC output signal.

First circuit means responsive to the DC output signal are provided for actuating fluid flow for a preselected period, thereby to enable use of said system in controlling faucet flow in a sink or other receptacle in response to the presence of the users hand.

Second circuit means responsive to the DC output signal are also provided. The second circuit means includes arming means for arming the circuit following the existence of the DC output signal for a first predetermined period, the said second means thereupon generating a flow control signal for a second predetermined period following extinction of said DC output signal, thereby enabling use of the system to control flushing of urinals and commodes.

Third circuit means responsive to the said DC output signal are also provided, enabling a flow control signal during the existence of said DC output signal, thereby to enable control of shower flow thereby enabling said system to be used for control of shower flow during the presence of a user in the shower.

Configuration selection means are selectively adjustable at installation of the system into a bathroom environment, to enable the installer to configure the system as to provide the DC output signal to one of the first, second or third circuit means, in accordance with the requirements of the installation.

The third circuit means may include manually switchable means operable by the user between first and second positions. The first position connects the DC signal to enable fluid flow; and the second position enables fluid flow for a preselected timeout period only, to enable the user to preset water temperature before returning the manual means to its first position.

BRIEF DESCRIPTION OF THE DRAWINGS

In order to facilitate the understanding of the present invention, reference will now be made to the appended drawings of preferred embodiments of the present invention. The drawings should not be construed as limiting the invention, but are intended to be exemplary only.

In the Drawings:

FIG. 1 is a perspective representation of a sink faucet combination of one embodiment of the invention having the light-source photosensor pair embedded in opposite side walls of the sink means, and being shown as schematically coupled to the control circuit means;

FIG. 2 is an abstract schematic representation of the faucet sink combination, showing the full light source-photosensor means embedded in the opposite side walls of the sink, with schematic notations of the electrical circuitry and valve control means contemplated;

FIG. 3 is a schematic diagram of an electrical circuit suitable for achieving the ends of the one embodiment of the present invention;

DESCRIPTION OF THE PREFERRED EMBODIMENTS

Figure 4:
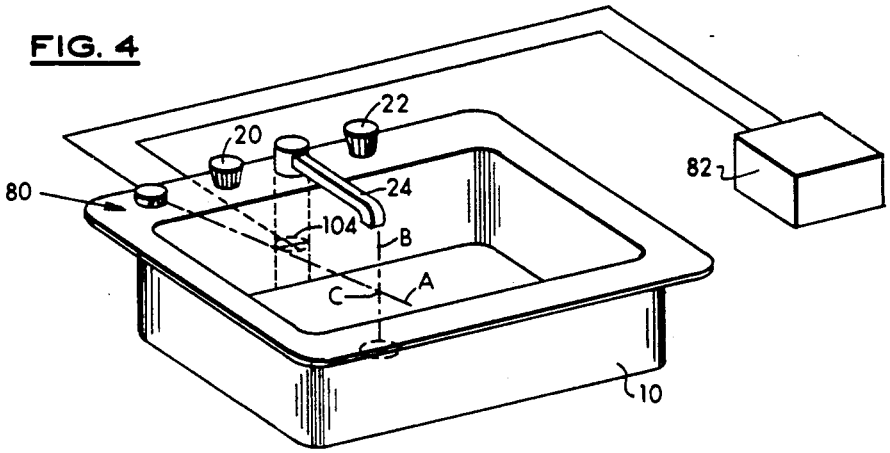
FIG. 4 is a perspective representation of a sink-faucet combination of another embodiment of the invention, having the light-source photosensor pair mounted in juxtaposition in a housing located on a back top surface of the sink, for example.

One embodiment of the present invention is shown in FIGS. 1 and 2, in which a sink can have embedded within its opposite side walls a light source 12 and a photoelectric sensor 14. By virtue of this arrangement the light beam 40 is caused to directly transit the internal volume of the sink 10. Electrical power source and circuitry means are schematically shown at 16. Element 16 may comprise a module which, while schematically shown to one side of sink 10, in practice may be mounted against one wall of the sink at the nonvisible underside of same. The power source may, of course, be either AC or DC with suitable battery component supplied or with coupling to an AC power supply through a transformer as shown, and will be discussed further in connection with FIG. 3.

As has been indicated above, the device here shown, consists essentially of a photosensor 14 coupled to a light source 12, so that interception of the light beam 40 emanating from the light source, will act through a control circuit to energize (or de-energize) a solenoid controlled ON/OFF valve, as to turn the valve on and permit water to flow through the faucet into the sink.

To be more specific in relation to the elements shown in FIGS. 1 and 2, it may be helpful to contemplate the typical operation of the described device, as it is being described. It is to be noted that the photosensor 14 and light source 12 are mounted embedded within essentially under or external to the sink, and may by suitable gaskets or rings and optical lenses be thoroughly separated from and protected from any water or other fluids flowing into the sink. Such provision of protective gaskets or rings and lenses is thoroughly conventional and well-known to those skilled in the art. In preparing the device for operation after installation of the light source 12 and photosensor 14, and the provision of suitable power and electrical control circuitry 16, (and assuming that solenoid-actuated valve 34 is at this point in an open condition) one adjusts the usual hot and cold water control valves 20 and 22 respectively to obtain the required mix of water for the desired water temperature. Turning on a switch such as switch 30, as shown in FIG. 2, energizes the photosensor 14 via a beam of light 40 emitted by light source 12 in response to the activation of switch 30. The turning on of switch 30 can for example activate a control circuit 32 which maintains the ON/OFF valve 34 in an OFF condition, thereby shutting off or precluding the flow of water through nozzle 24 into sink 10. Valve 34 as seen in FIG. 1, is conveniently provided in the water supply line 13 to nozzle 24.

Breaking the beam 40 of light, as for example, by placing ones hands within the sink—as schematically indicated in FIG. 2 by the shadow line 42—serves via control circuit 32 to place ON/OFF valve 34 into an ON condition, thereby permitting water to flow freely through the nozzle of faucet 24.

The net effect of the above described operations is as indicated above, to provide water at sink 10 only when it is actually needed and to be used. For example, when shaving, many people allow the water to run while applying the shaving cream to their face, and leave it running throughout the shaving process so as to be able from time to time to clean off the razor while shaving The present invention automatically provides for the water to be shut off while the person's hands are in an area suitable for applying the shaving cream to their face and during the period while the individual is actually shaving. However, the mere placement of the hands or a razor into the sink under the faucet serves to turn on the flow of water at the same hot and cold water mix as initially established, by breaking the photoelectric beam to reactivate the flow of water. As will be readily understood by those skilled in the art, the present invention may be likewise employed when people are brushing their teeth, washing their hair, washing dishes, or even in the course of taking showers—provided a suitable similar installation applying the above described photosensor and light source concept is employed in the shower enclosure, e.g., so that the light beam is interceptable by the body of the individual showering.

The installation of the devices of the present invention in homes, apartments, motels, hotels, hospitals, prisons, military bases, ships, office buildings, airline terminals, restaurants and industrial establishments will serve to save millions of gallons of water a day automatically, with the only effort required by the public being the breaking of the beam by the insertion of their hand under the faucet or within the area of the photoelectric beam. As will be understood, this type of water conservation places no hardship upon anyone, while providing exactly as much water as needed to do the job intended, and at a pre-determined temperature.

While the above description of one embodiment of the invention has been related to a conventional faucet and water sink basin, it will be readily appreciated by those skilled in the art that numerous other types of liquid and fluid faucet sink systems may readily adapt and employ the principles of all the embodiments of the present invention. For example, dispensers of carbonated beverages, beers, and even some liquid fluids, such as soaps and detergents, may usefully be controlled by means of the present invention. As previously noted above, the hot water saved results in a significant savings of energy in the form of oil, gas and electrical energy used to heat the water. Indeed, the savings in terms of the cost of energy saved is or can be even more significant than the savings in the cost of water saved. It will be noted in accordance with the above description, that the present invention is in no way limited to the two hot and cold water systems referred to, but may be adapted for use on single faucet sinks, with single control devices for the adjustment of water temperature.

The present invention will no doubt ultimately be an integral part of many sinks manufactured, and may readily be installed on existing sinks by the supplying of a kit with instructions for installation by any plumber, electrician or handy individual.

As noted above, the light-source photosensor combination can be installed under and embedded in the sides of the sink and suitable protection by way of lenses, rings or gaskets may provide adequate protection for the sink feed-through and protection of the electrical components of the lamp and photo sensor from any contact with the water or other fluids flowing into the sink. As the above items are conventional and well-known to those skilled in the art, further description of them is not believed appropriate. As used in the present application, the term "faucet" is intended to be understood by those skilled in the art as sufficiently broad to encompass any dispensing means, and the term "sink" sufficiently broad in its scope to refer to any receiving and/or retaining means for receiving or holding other vessels for the receipt of fluids from an appropriate dispensing means, such as may be readily understood to be employable in connection with carbonated beverages, beer dispensers and the like.

While the above description is exemplary of one circuit arrangement suitable for providing optical coupling of the light-source photosensor arrangement so as to provide for the interception of the light path across the interior of the sink or other wash basin, it will be readily appreciated by those skilled in the art that additional refinements to the electrical circuitry and valving means may be made.

One embodiment of an electrical 32 or 16 circuitry for achieving the ends of the one embodiment present invention, is shown in FIG. 3. In FIG. 3, transformer 50, diodes 52 and 54, and the filter capacitor 56 form a conventional power supply to yield typically a +12 volt DC source of power. The lamp 58 is typically a long-life lamp rated at 6 volts, leaving a voltage drop of 6 volts to be developed across resistor 60. The remaining 6 volt drop is applied to resistor 62. The lamp 58, is as indicated in FIGS. 1 and 2, optically coupled to phototransistor 64, which when illuminated by lamp 58, will hold the base of transistor 66 at a sufficiently low voltage so that transistor 66 will not conduct. When the light beam 40 is interrupted, as by the placing of hands within sink 10, photo transistor 64 will cease conducting current, and the current resulting from the potential applied will instead flow into the base of transistor 66 turning it ON. As transistor 66 is turned ON, it will serve to energize solenoid coil 68, to permit the solenoid to open the (normally closed) valving means, such as valve 34, controlling flow from the faucet 24 in FIG. 2.

Should lamp 58 fail, then no voltage will be developed across the resistor 60, and consequently no current can then flow in resistor 62 and the solenoid coil 68 cannot be energized. Diode 70 shown in FIG. 3, prevents a high voltage inductive surge from being developed across solenoid coil 68 when the light beam is once more coupled from lamp 58 to the phototransistor 64, and the presence of diode 70 thus serves to protect the transistor 66.

The operation of the device is further enhanced by the provision of an automatic safety timer device shown at T in FIG. 3, which is included to provide for the accidental or mischievous intentional covering of the photoelectric beam causing the water to turn on and flow continuously Automatic timer T will automatically bypass the control signal from 66 and cause the water to shut off after it has been running for a predetermined period of time, for example, 15, 20, 30 or more seconds. The timer can be preset at the point of assembly, or T can be subject to adjustment and setting by the person establishing or controlling the system at the faucet sink. In operation, the insertion of one's hands into the sink, serves to disrupt the photoelectric beam, turning on the flow of fluid from the faucet. The accidental or mischievous intentional breaking of the photoelectric beam thus is countered by provision of the circuit shown in FIG. 3, which results in a bypassing of the light source-photosensor pair by an overriding safety timer T, which will shut off the flow of fluid at the conclusion of a predetermined period of time. The failure of the light source 58 will likewise not produce a continuous running of the water because of the circuitry discussed, which prevents the flow of current into solenoid coil 68, and thus prevents the opening of the faucet to provide flow into the sink.

The provision of suitable safety interlocks, such as the override timer and the fail-safe light failure features of the present invention, serve to further enhance its utility and applicability to the general public.

Figure 6:
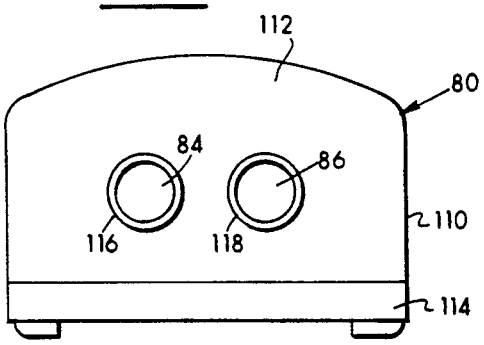
FIG. 6 is a front view of the sensor assembly of the FIG. 4 embodiment of the invention.
Figure 7:
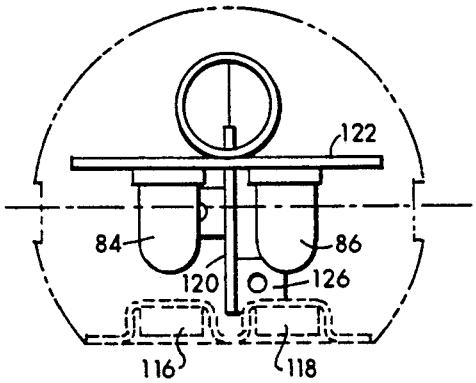
FIG. 7 is a top view of the sensor assembly of FIG. with the cover removed.
Figure 5:
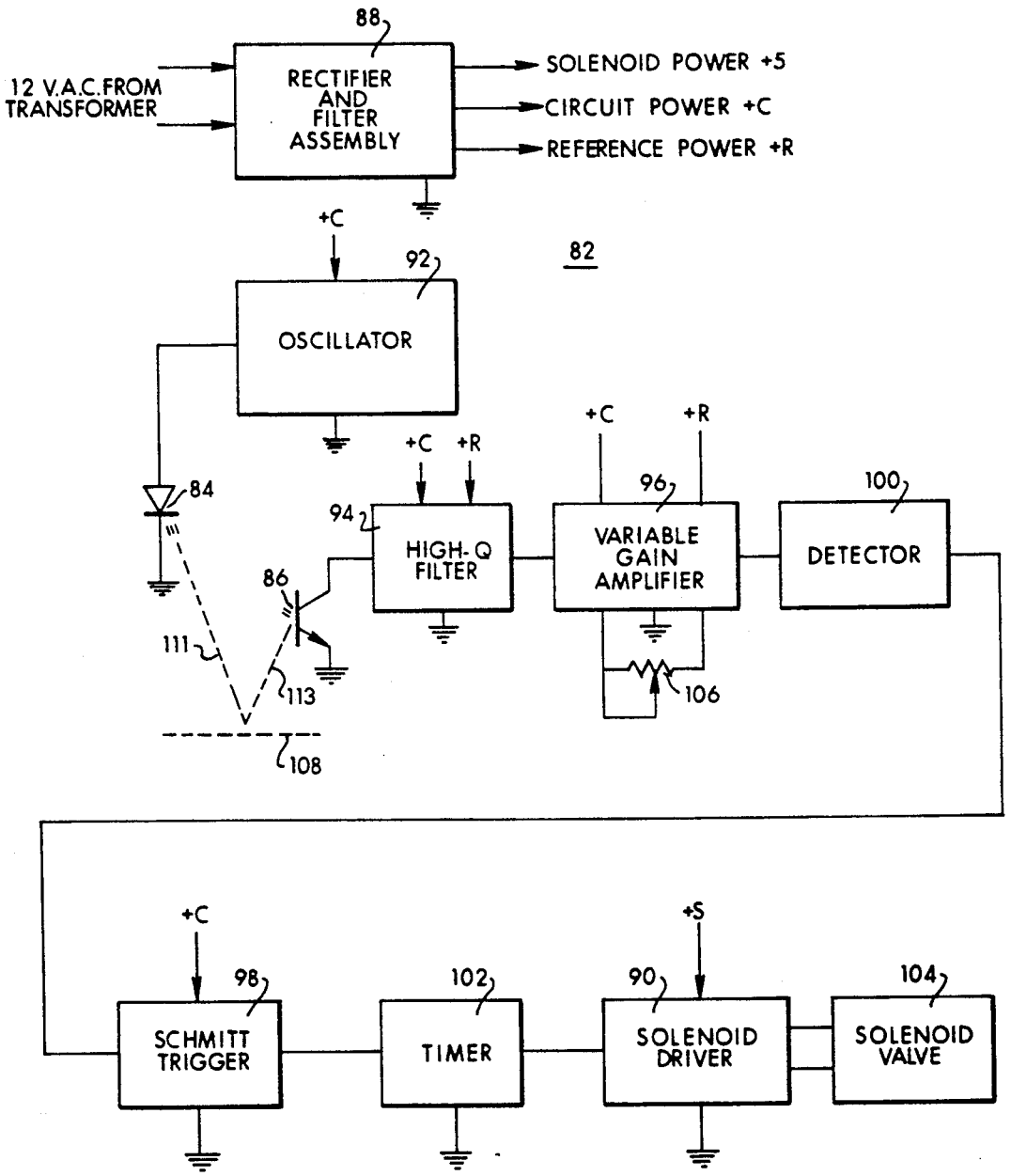
FIG. 5 is a block schematic diagram of the electrical circuitry of the FIG. 4 embodiment of the invention.

With reference to FIGS. 4 and 5, a preferred embodiment of the invention includes a sensor assembly 80 mounted on the sink 10 along the top back surface as shown, or mounted in some other suitable position to the rear or behind the sink. Control circuitry 82 is connected to both the sensor assembly and the solenoid actuated valve 104, as shown. The sensor assembly 80 includes an infrared light emitting diode 84 mounted in juxtaposition to a phototransistor 86 (see FIGS. 6 and 7). As shown in FIG. 4, the cones of vision of the light emitting diode (LED) 84 and the photosensor 86 are focused along a line A to intersect the normal flow path of fluid (in this case water), along path B from faucet 24. Typically, the cones of vision of both the LED 84 and photosensor 86 are about 20°, in this example.

With further reference to FIGS. 4 and 5, the control circuitry 82 in the depicted embodiment, includes a rectifier and filter assembly 88 for converting, in this example 12 volts AC from a transformer (not shown) to three distinct DC supply voltages. One voltage is designated as +S, for supplying power to a solenoid driver 90; another output voltage +C is for supplying circuit power to an oscillator 92, to a high-Q filter 94, a variable gain amplifier 96, and a Schmitt trigger 98. The control circuitry 82 also includes a detector 100, a timer 102, and at least one solenoid valve 104. A gain control potentiometer 106 is provided for adjusting the gain of the variable gain amplifier 96. The rectifier and filter assembly 88 also provides a reference power voltage +R to the high-Q filter 95 and variable gain amplifier 96.

With further reference to FIGS. 4 and 5, operation of the depicted embodiment of the invention will now be described. The oscillator 92 supplies a fixed frequency excitation voltage to the infrared light emitting diode 84. The frequency of the excitation voltage is selected to be different from a harmonic of the line frequency, typically 60 Hz in the United States. In this example, the frequency of the excitation voltage was selected to be 750 Hz. Such a frequency lies halfway between the twelfth harmonic of the line frequency (720 Hz) and the thirteenth harmonic of the line frequency (780 Hz).

If an object representing a reflecting surface, such as a hand, is placed beneath a faucet or spout 24, infrared light energy emitted from LED 84 is reflected from the object or hand back to the phototransistor 86, the latter responding by providing a low level output signal to the high-Q, high gain filter 94. The filter 94 has its response tuned to the frequency of the oscillator 92 (in this example, 750 Hz as previously mentioned). The output signal from the filter 94 is provided as an input signal to the variable gain amplifier 96. The gain control 106 of the amplifier 96, provides adjustment of the sensitivity of the control circuitry for compensating for circuit component variations and differences in the positioning of the LED 84 and the phototransistor or photo-detector 86 relative to the path of water flow B from the faucet 24. The amplified signal from the amplifier 96 is provided as an input signal to the detector 100. The detector 100 demodulates or rectifies the AC signal from the variable gain amplifier 106, and provides a DC output signal representation thereof to the Schmitt trigger 98. If the level of the DC output signal from detector 100 is greater than the trigger level for the Schmitt trigger 98, the Schmitt trigger 98 will respond by providing an output or a trigger signal to timer 102, thereby activating the timer. The Schmitt trigger 98 is provided with a controlled hysteresis transfer function for insuring that the water flow from the faucet 24 will not be shut off by the control circuitry until the hands (not shown) are completely withdrawn from beneath the faucet 24.

The timer circuit 102, when driven by the output from the Schmitt trigger 98, provides a turn-on signal for operating solenoid driver 90 to turn on one or two solenoid valves 104. The timer 102 provides the turn-on signal for a predetermined period of time, typically not more than one minute, for maintaining the solenoid driver 90 in an active state for holding the solenoid valves 104 in a turned on condition, to permit water to flow through the faucet 24. If the hands are withdrawn before timer 102 has timed out, the reflection surface 108, representing the hands, will no longer be available to reflect the light beam 111 from the surface 108 to the photo-transistor 86, the reflected light being represented by reflected light path 113, whereby the timer circuit 102 will be reset. The turn on signal to the solenoid driver 90 also will be terminated, thereby turning off the solenoid valves 104 before the timer 102 has completely timed itself out.

Contrariwise, if the hands represented by reflective surface 108 remain under the faucet 24 for longer than the predetermined time period (typically one minute) of the timer 102, the timer 102, after the predetermined period of time, will terminate the turn-on signal to the solenoid driver 90, turning off the solenoid valve or valves 104, thereby terminating the flow of water from the faucet 24. If a person using the sink desires additional water, the person must remove his hands from beneath the faucet 24 and then reinsert them thereunder in order to obtain an additional minute of water flow, in this example.

The flow of water and the temperature thereof are controlled in the normal manner by adjusting the usual hot and cold water control valves 20 and 22, respectively, as previously mentioned. With reference to FIGS. 6–10, the sensor assembly 80 includes a housing 110 consisting of a cover 112 and a base 114. A clear window 116 is provided in the cover 112 for the infrared light emitting diode 84 mounted behind the window 116. Similarly, a red window 118 is provided in the cover 112 preventing ambient light from being picked up by the phototransistor 86 mounted behind the window 118, while permitting reflected infrared light from the LED 84 to pass through the window 118 for detection by the phototransistor 86.

Figure 8:
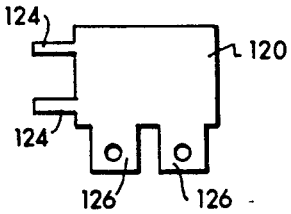
FIG. 8 is a plan view of the blank for the sensor shield of the FIG. 6 embodiment of the invention.
Figure 9:
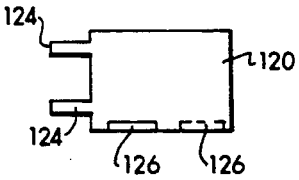
FIG. 9 is a side view of the sensor shield with mounting tabs bent to final configuration.
Figure 10:
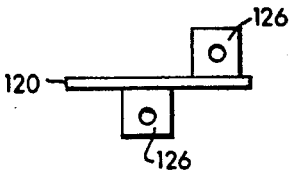
FIG. 10 is a bottom view of the completely fabricated sensor shield.

A shield 120 is located between the LED 84 and the phototransistor 86 for preventing light emitted by LED 84 from leaping over to the phototransistor 86, causing false triggering of the solenoid actuated valve 104. A printed circuit board 122 is mounted on tabs 124 of the shield 120. The shield 120 is shown in FIG. 8, with mounting tabs 126. The mounting tabs 126 are bent as shown in FIGS. 9 and 10, for receiving screws (not shown) for mounting the shield to the base 114. The sensor assembly 80 can be positioned anywhere in the back-up portions of the sink 10. For example, the sensor assembly 80 could be mounted on the horizontal portion of the sink 10, or for sake of simplicity, it could be mounted in the adjacent portion of a vanity associated with the sink 10, or on a wall directly behind the sink 10, for example. As previously mentioned, in the preferred embodiment, the sensor assembly 80 must be oriented for insuring that the field of vision of the LED 84 and phototransistor 86 are along the sight line A of FIG. 4, and coincide about a point C intersecting the water flow path B.

Figure 11:
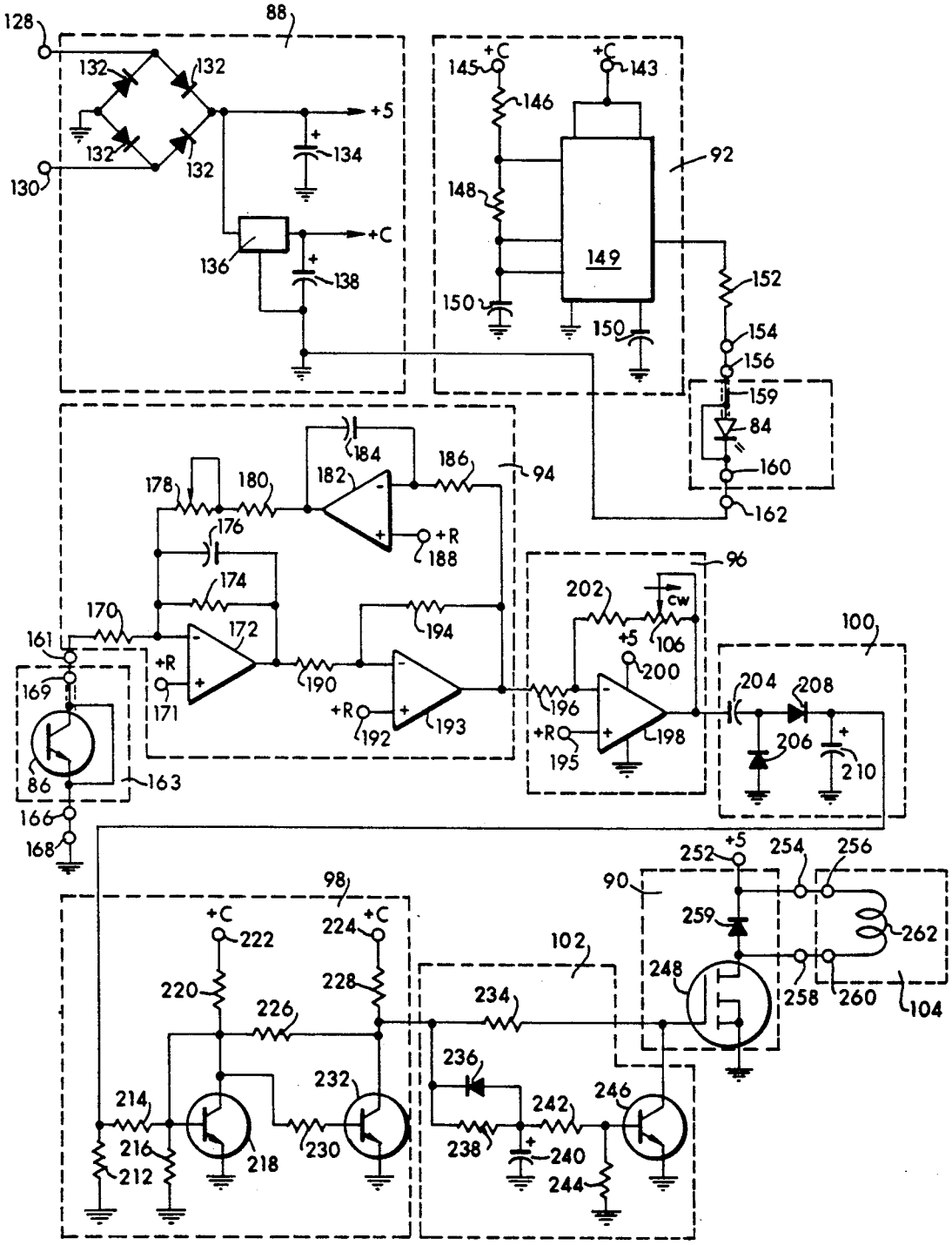
FIG. 11 is a circuit schematic diagram of the FIG. 6 embodiment of the invention.

The present inventor used the circuitry shown in FIG. 11 for providing the control circuit 82 of the depicted embodiment of the invention, in this example. The rectifier and filter assembly 88 includes a pair of terminals 128 and 130 for receiving the input 12 volt AC from a transformer (not shown), which voltage is rectified by the full-wave rectifier including diodes 132. The output of the full-wave rectifier 132 and capacitor 134 directly provides the solenoid drive voltage or power +S (+15 volts, in this Example).

The common circuit voltage +C and reference voltage R (+5 volts in this Example) are provided from a regulator 136 with a filter capacitor 138. The oscillator 92 consists of a timer module 149 (int his example an NE555 commercially available from a number of manufacturers). The frequency of oscillation of this module is determined by the combination of resistors 146 and 148 and capacitor 150. These components are precision components and selected for providing a frequency of oscillation of 750 Hz, the preferred frequency of oscillation. Resistors 146 and 148 are connected in series with capacitor 150 between terminal 145 and ground with common connections therebetween connected to the module 149, as shown.

The power is connected to module 149 via terminal 143. A second capacitor 150 is also connected to the module 149. The fixed frequency excitation voltage from the oscillator 92 is 750 Hz, as previously mentioned, in this example. The excitation voltage is coupled by a resistor 152 to terminal 154, and therefrom to terminal 156 for application to the infrared emitting diode 84 connected between terminals 156 and 160. The infrared emitting diode 84 is provided by a TIL 39, manufactured by Texas Instrument Company, in this example. A shield 159 is provided around the lead from the terminal 156 to the anode of the LED 84, and the shield 159 is electrically connected directly to the cathode lead of the LED 84, for the purpose of preventing capacitive coupling of the excitation signal to the much lower level return signal, which is detected by phototransistor 86. Terminal 160 is connected via terminal 162 to ground, for grounding the cathode of the LED 84, and for providing a source of ground reference potential for the shield 159.

The phototransistor 86 is connected between terminals 163 and 166, as shown, and is in this example, a TIL 414, manufactured by Texas Instrument Company. The collector lead of phototransistor 86 is connected via a shielded line to the terminal 163, with the shield 169 being terminated to ground via the connection of terminal 166 to ground reference terminal 168, as shown. The purpose of the shielding 169 is to prevent capacitive coupling of the excitation signal to the much lower level return signal, which is detected by phototransistor 86. The emitter of the phototransistor 86 is connected to ground via terminals 166 and 168, whereas its collector is connected to input resistor 170 of the high-Q filter 94 via terminals 163 and 161, as shown. The high-Q filter 94 is an active filter including operational amplifiers 172, 182, and 193. The non-inverting terminal of operational amplifier 172 is connected via terminal 171 to reference voltage +R. The inverting terminal of operational amplifier 172 is connected to input resistor 170, to the common connection of feedback resistor 174 (the other end of which is connected to the output terminal of amplifier 172), feedback filter capacitor 176 shunting resistor 174, and one end of potentiometer 178. The other end of potentiometer 178 is connected via resistor 180 to the output of operational amplifier 182. A capacitor 184 is connected between the inverting and output terminals of amplifier 182. The inverting terminal of amplifier 182 is also connected via input resistor 186 to the output terminal of amplifier 193. The non-inverting terminal of amplifier 182 is connected via terminal 188 to the reference potential +R. A feedback resistor 194 is connected between the output and inverting input terminals of amplifier 193, and its non-inverting input terminal is connected via terminal 192 to reference potential +R.

The output signal from the high-Q filter 94 is connected via input resistor 196 to the inverting input terminal of amplifier 198 of the detector 100. The detector 100 also includes a terminal 195 for connecting the reference potential +R to the non-inverting input terminal of the variable gain amplifier 198 of the amplifier block 96. The amplifier block 96 also includes a terminal 195 for connecting the reference potential +R to the non-inverting input terminal of amplifier 198, a terminal 200 for receiving the solenoid power voltage +S for connection to amplifier 198, and a feedback loop between the output terminal and inverting input terminal of amplifier 198 including a fixed resistor 202 and a potentiometer 106. The output terminal from amplifier 198 is connected to detector 100.

The detector 100 provides for demodulation or rectification of the output signal from the variable gain amplifier 96, as previously mentioned. Input capacitor 204, connected to the common connection of diodes 206 and 208, capacitor 210, all connected as shown, provide the function of detector 100. The voltage developed across the capacitor 210 represents the detected DC representation of the output signal from the variable gain amplifier 96. This DC signal is fed to the Schmitt trigger 98 via the connection between capacitor 210 of detector 100 and the common connection of resistors 212 and 214 of the Schmitt trigger 98. The Schmitt trigger 98 also includes resistors 216, 220, 226, 230, and 228, terminals 222 and 224 for receiving circuit power voltage +C, and transistors 218 and 232, all connected as shown.

Assuming that the DC voltage level of the detected signal from detector 100 is higher than the threshold voltage point of the Schmitt trigger bipolar 98, transistor 218 will be turned on, for substantially connecting the base of transistor 232 to ground, causing bipolar transistor 232 to be cutoff, in turn causing the collector of transistor 232 to approach the level of the circuit power +C. When transistor 232 so becomes cutoff, timing circuit 102 will become activated, whereby capacitor 240 will begin charging via current received from resistor 238 towards a predetermined positive voltage level, concurrent with the positive voltage at the collector of transistor 232 being applied via resistor 234 to the data electrode of the MOSFET transistor 248 of the solenoid driver circuit 90, causing the latter to turn on. Once MOSFET transistor 248 so turns on, current is permitted to flow from the +S solenoid power source into terminals 252, 254, and 256, for delivery to the solenoid winding 262 of the solenoid actuated valve 104, and therefrom via terminals 258 and 260 through the channel of MOSFET transistor 248 to ground. In this manner, the solenoid actuated valve 104 (more than one valve may be turned on) for permitting fluid to flow from a source of fluid through the faucet 24.

As previously mentioned, if one's hands are inserted beneath the faucet 24 for longer than the predetermined timing cycle of timer 102, the capacitor 240 will charge to a level for turning on transistor 246, which in turn will ground the gate of MOSFET transistor 248, turning off the latter for terminating the flow of current through the solenoid coil 262, for turning off the solenoid actuated valve 104 and terminating the flow of fluid through the faucet 24. If, however, the hands were removed from the vicinity of the faucet prior to capacitor 240 charging to a level for turning on transistor 246, the termination of an output signal from phototransistor 86 is sensed by the control circuit 82, causing the Schmitt trigger 98 to return to its quiescent state, via the level of the DC signal from the detector 100 reducing to below the threshold level of the Schmitt trigger 98. The latter action causes transistor 218 to turn off, causing the base of transistor 232 towards the level of voltage +C, in turn causing transistor 232 to turn on for grounding the gate of MOSFET transistor 248, turning the latter off, for in turn turning off the solenoid actuated valve 104, as previously described for the timing out of timer 102.

The cycle is repeated when hands or some reflective object are placed beneath the faucet 24, causing reflected infrared light from LED 84 to again be reflected into the base center of phototransistor 86, causing the latter to produce an output signal which is filtered by filter 24 and amplified by amplifier 96, whereafter the amplified signal will again be demodulated by detector 100, for providing a DC level to trigger Schmitt trigger 98, and again initiate the turn on of the solenoid valve 104 and triggering of timing cycle for timer 102, as previously described. In actual practice, the control circuit 82 as illustrated herein, was found to be extremely reliable.

Figure 12:
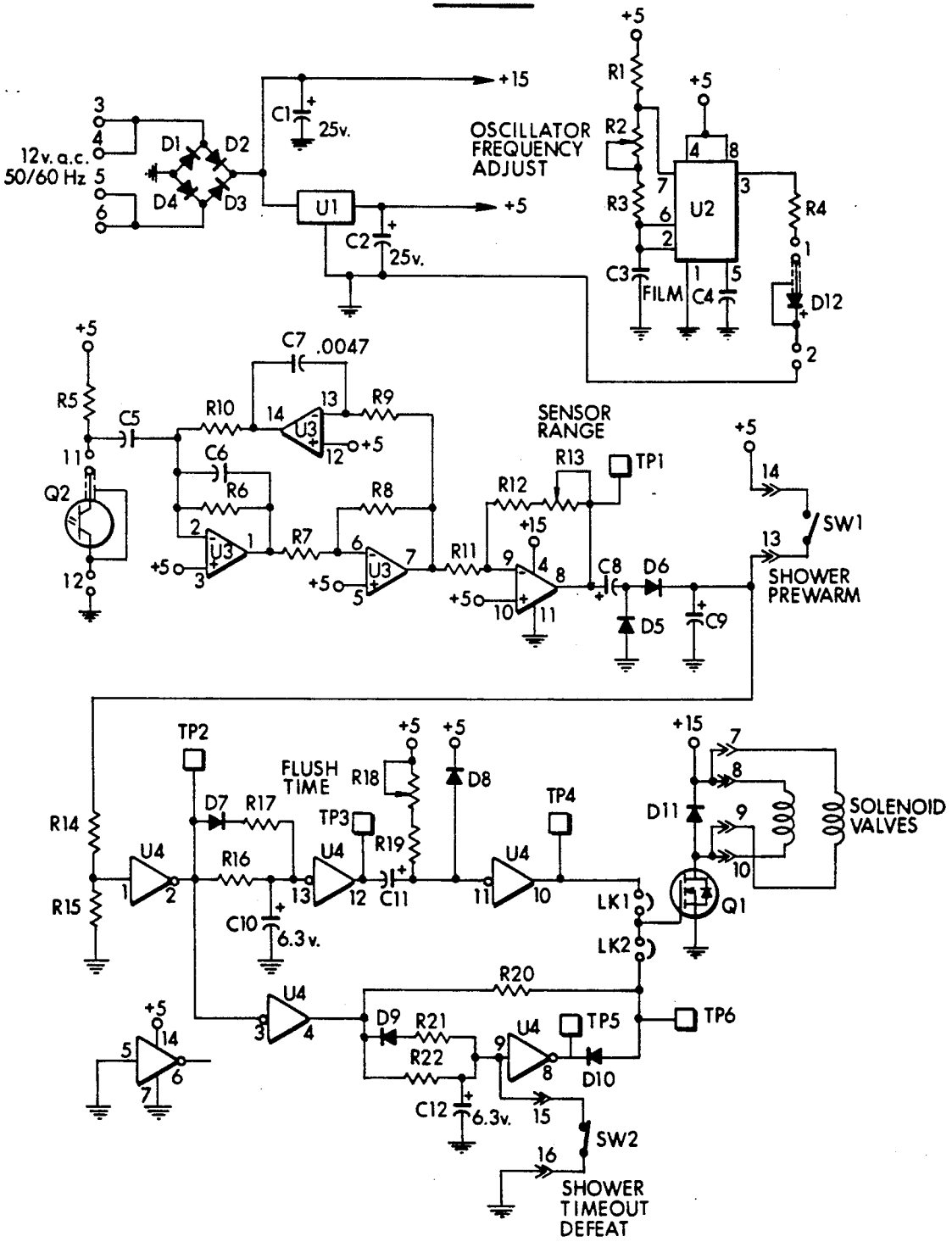
FIG. 12 is a circuit schematic diagram of a further embodiment of the invention.

In FIG. 12, an electrical schematic diagram appears, in which the embodiment of the invention thus far described, has been modified, as to provide a particularly useful system for use in controlling liquid flow in bathrooms and similar environments, in response to the presence of the user. The special attribute of the system shown, is that the configuration of same can be very simply adjustable by the installer, as to permit a variety of specific and valuable, preselected sanitary applications, as will now be discussed.

The system depicted in FIG. 12 is generally similar to that of FIG. 11; more specifically up to the point where the detected signal is rectified at the output of D6, the present and previous systems are nearly identical, with the exception that the frequency of the oscillator circuit is adjusted by potentiometer R2 rather than having the oscillator circuit operate at a constant frequency and the filter center frequency adjusted.

In the system of FIG. 12, features have been added so that the same "board" can now be used in a number of different applications:

(1) Normal water dispensing mode as previously described;

(2) For flushing a urinal after the user leaves;

(3) For flushing a tank toilet after the user leaves; and (4) For use in a shower.

The circuit can also be readily used in connection with initiating the dispensing of soap solution. Additionally it readily lends itself to a further use in the bathroom environment, i.e., operating a hand dryer.

These several configurations will now be discussed.

NORMAL WATER DISPENSING MODE

Referring to FIG. 12: With the sensor being substantially of the design previously discussed, the presence of an object in the range of the sensor will cause the voltage across C9 to rise above a predetermined level, e.g., 8 volts. U4 is a Hex Schmitt Trigger inverter similar to the 74HC14. When the output voltage developed across C9 is attenuated through R14–R 15 and applied to the input of U4 pin 1 exceeds the trigger voltage required by the inverter then the output at pin 2 will go to near ground potential. The output at pin 4 of the inverter will rise to near the supply voltage. This voltage is applied to two branches of a circuit which will cause water to be dispensed. The voltage applied through R20 and a selectable link LK2 to the gate of Q1 will turn on Q1 and operate the solenoid valve(s). At the same time the output of U4 pin 4 is applied to the circuit consisting of R22, C12 and U4 pin 9. The values of R22 and C12 are selected such that the trigger voltage at U4 pin 9 is reached after approximately 30 seconds. At that time the output of U4 pin 8 will go towards ground and the voltage applied to the gate of Q1 will be reduced to less than 1 volt by diverting the current flow through R20 to the gate of Q1 through D10 into U4 pin 8. This will turn off the solenoid valve(s) and the water flow will stop. When the voltage at U1 pin 1 drops below the lower trigger voltage of the inverter then the voltage at U4 will go to near ground level and the charge accumulated on C12 will be bled off rapidly through R21 and D9 and as soon as an object is detected in the range of the sensor water is again dispensed.

URINAL FLUSHING

For this application LK1 is selected instead of LK2. When a user appraches the urinal the voltage at U4 pin 1 will exceed the trigger voltage and U4 pin 2 will go to near ground. The positive voltage which was present at C10+ will bleed off through R16 with a time constant determined by the values of C18 and R16. The time for this voltage to become less than the lower trigger voltage at U4 pin 13 is selected as 5 to 7 seconds. After the user's presence has been detected for that period of time, U4 pin 12 will go positive and C11− will rise towards the supply voltage rapidly, current flowing through D8 to the supply voltage. Nothing further will happen until the user of the urinal leaves. At that time the voltage at U4 pin 2 will rise to near the supply voltage and after a suitable delay determined by the relative values of R17 and C10, the trigger voltage at U4 pin 13 will be exceeded. U13 pin 12 will then jump to near ground level and the output of U4 pin 10 will rise to near supply level. This voltage will then be applied to the gate of Q1 through LK1. The voltage at C11+ will gradually rise to the supply voltage through R18 and R19 with a time constant determined by the setting of R18 together with the value of R19 and the value of C11. These values have been selected to yield a time of operation settable to between 1 second and 11 seconds but this may be revised. Once the voltage at C11+ exceeds the trigger voltage at U4 pin 11, the output of this inverter will go to near ground and Q1 will be turned off.

The overall action is then one of arming the circuit by detecting the presence of a user for a predetermined time, e.g., 5 seconds, waiting until a second predetermined interval after the user leaves, at which time the solenoid is operated for a third predetermined and adjustable time to flush the urinal.

TANK TOILET

Figure 13:
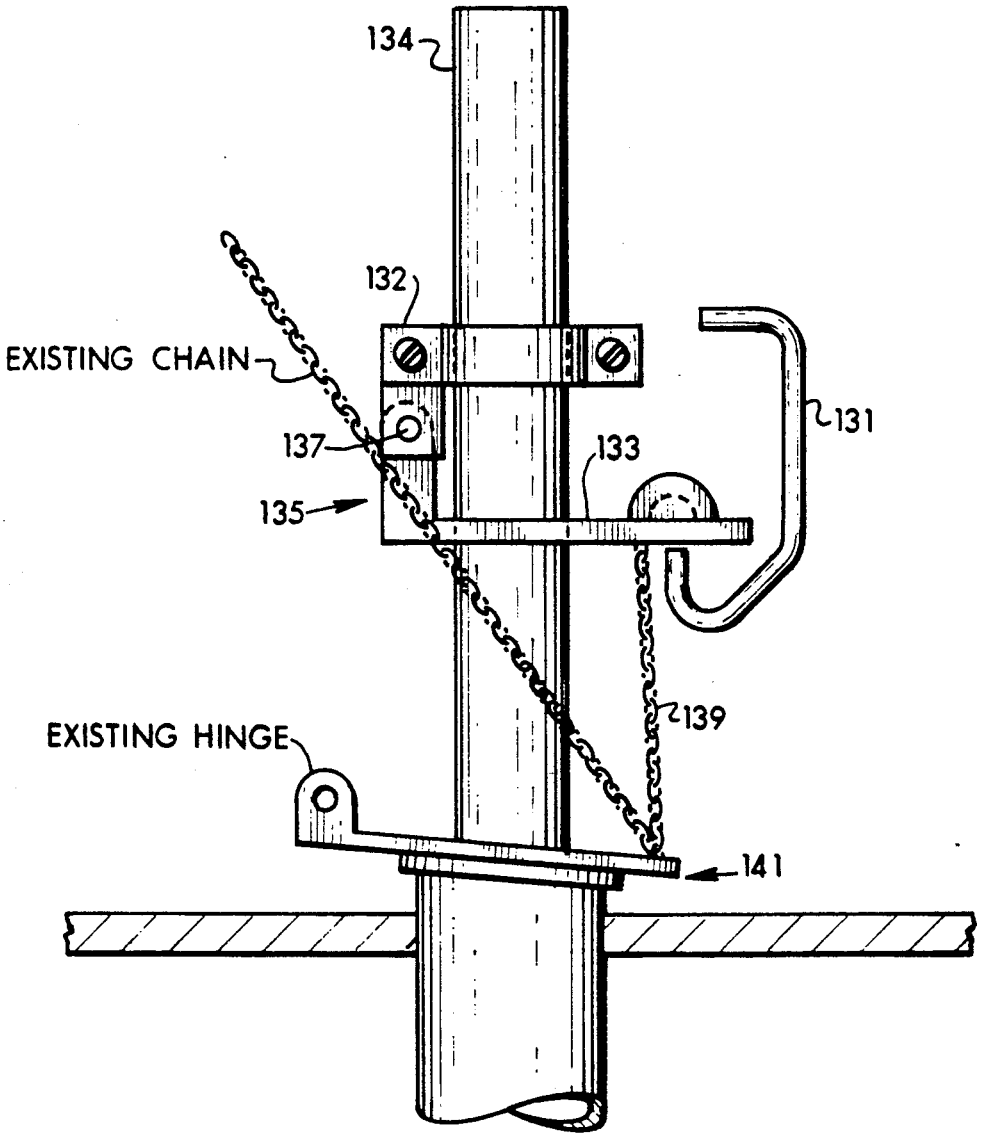
FIG. 13 is a simplified schematic diagram, depicting how a system in accordance with the invention may be used to control flushing of a commode.

The action of the circuit for flushing a tank toilet is precisely the same as the action for flushing a urinal. However the water flowing out of the delivery of the solenoid valve is used to actuate the flapper valve in the tank toilet and will ensure that the flapper valve is kept raised until the flush is completed. The mechanical aspects of this operation are illustrated in the schematic plan of FIG. 13, where it is seen that the water flow from tube 131 enabled by the control signal impinges directly against the bottom surface of a hinge means 135 (secured by clamp 132 to overflow pipe 134), to displace same about pivot 137. Flexible chain link 139 extending from means 135 to the conventional flapper valve 141, causes the latter to open, and thereby flush the commode.

SHOWER USE

For use in a shower LK2 is selected and two switches SW1 and SW2 are incorporated, shown wired across points 14, 13 and points 15 and 16. These switches are preferably sealed reed switches which are operated by a moveable magnet. Before a user enters the shower it is desirable to permit adjustment of the water temperature. The user will move the magnet to close SW1 and open SW2. The circuit will cause water to be dispensed for approximately 30 seconds as described in the "Normal Water Dispensing Mode" infra. If the user requires more time, the magnet will be moved to open SW1 and close SW2 which will reset the timeout circuit. Moving the magnet once more to the SW1 closed and SW2 open position will once again permit the flow of water for approximately 30 seconds. At any time the magnet may be moved to the SW2 closed and SW1 open position, at which time the flow of water will stop until the user steps into the shower and is detected by the sensor. At that time water flow will start and not stop until the use is out of range of the detector, e.g., by stepping towards the wall of the enclosure remote from the sensor. The sensor itself is preferably mounted as to be angled with respect to the shower enclosure, so that the user must be standing within the useful shower head dispersion pattern before the water will start to flow. To save water it is a part of this specification that the soap supply is located not at the side of the shower enclosure next to the shower head but on the wall of the enclosure opposite the shower head. This will ensure that the user will step out of the range of the sensor to retrieve the soap and probably stay there until the soap is replaced in the soap dish.

HAND DRYER CONTROL

For use in controlling a hand dryer, selectable link LK2 and Q1 are used to operate a heavy current relay which controls the heater and blower motor supply. In all other respects the action will be the same as described in the "Normal Water Dispensing Mode". The time constants selected for the timeout can be changed to permit operation up to a full minute or even more if that time should be appropriate.

In all applications, the oscillator circuit of U2 plus its associated components will energize the Infrared Emitter Diode (IED) with a square wave of approximately 750 Hz. The output drive is fed to the IED, which is located in a remote sensor head, through a single shielded wire. No significant EMI radiation has been found using this shielded wire. The signal, which is the result of a reflective surface being detected by Q2 is turned to the control circuit by a second shielded wire.

The 750 Hz return signal is amplified through a high Q bandpass filter formed by three sections of U3 together with the components associated with these three sections and then amplified in the fourth section of U3. The gain of this fourth section of U3 is determined by the setting of R13, hence the range of detection can be varied from a minimum of about 3 inches to at least 24 inches. The measurement target was a 2"×3" white file card held at right angles to the beam. This is adequate for most applications.

The output of the fourth section of U1 is rectified through D5 and D6 and the resulting DC signal is applied through R14 and R15 to the Pin 1 input of a CMOS Hex Schmitt Trigger inverter U4 at Pin 1.

Figure 14:
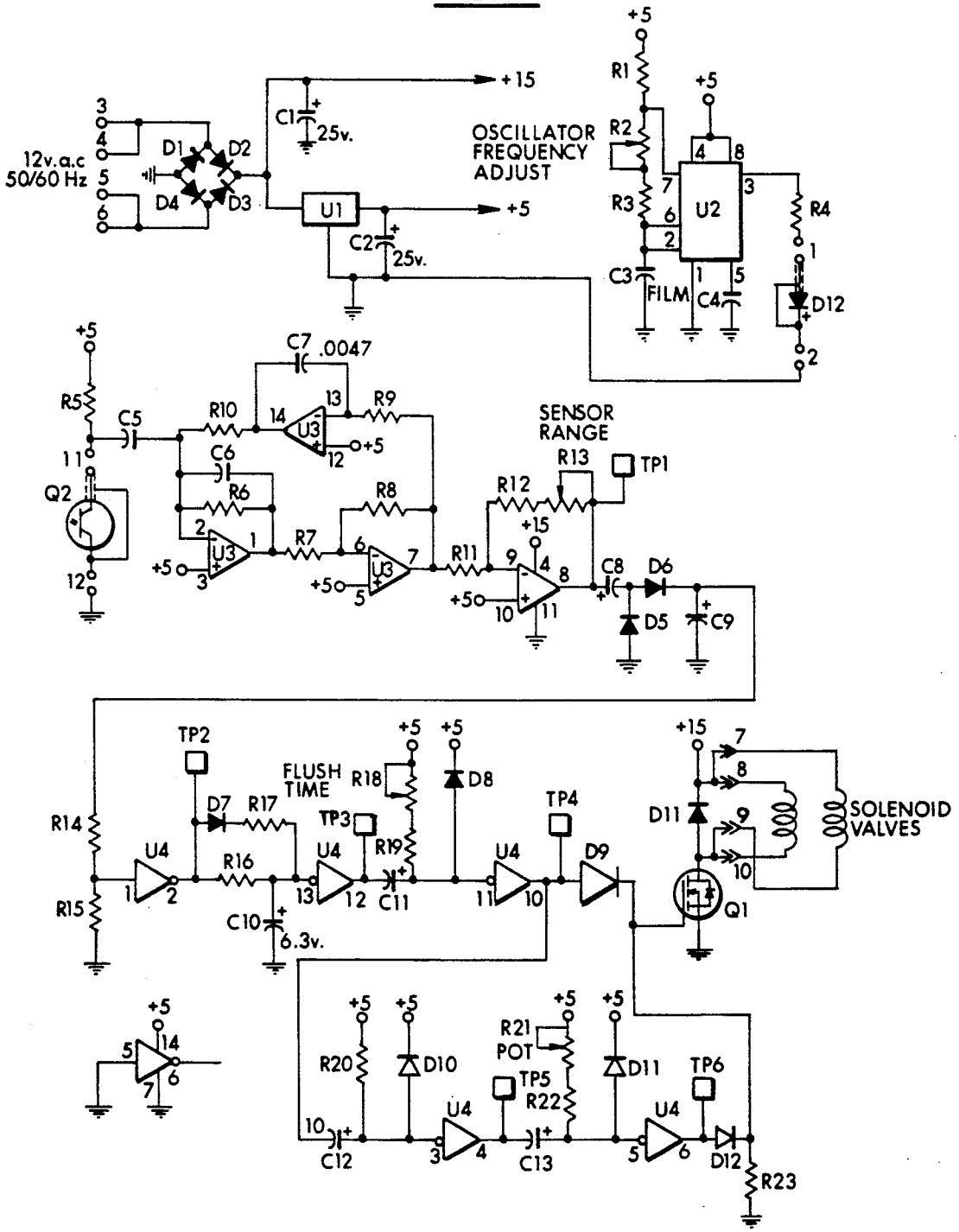
FIG. 14 is a circuit schematic diagram similar to FIG. 12, but including a modification rendering the circuit particularly suitable for use in flush toilets and urinals.

FIG. 14 is an electrical schematic diagram, generally similar to FIG. 12, but including several modifications rendering the circuit suitable for use in flush toilets and urinals.

When the control board is required to deliver a selectable amount of flushing water for use in a flush toilet or a urinal, the gate of Q1 is connected to U4 Pin 10 through diode D9. The operation of that part of the circuit consists of two sequences.

In the first step of the flushing operation, the output of U4 Pin 2 goes to ground when the presence of a reflecting body is detected. The voltage at the junction of C10 and R16 now ramps towards ground with a time constant determined by the values of C10 and R16. As soon as the voltage has reached the lower threshold voltage at U4 Pin 13, U4 Pin 12 will go to +5 volts, bringing the input side of C11 to the same voltage. This process is called "Arming" the device. The values of C10 and R16 have been selected to yield an arming time of approximately 5 seconds. Should the person move away from the sensor before the 5 seconds elapsed then the voltage across C10 will rise very quickly to 4.4 volts and the arming cycle must be repeated before flush water is delivered.

Once the device is armed, then as soon as the person in front of the sensor leaves, the voltage at U4 Pin 12 will go to ground. The voltage at U4 Pin 11 will drop below the threshold voltage and U4 Pin 10 will apply 5 volts to the gate of Q1 through diode D9 and water will commence to flow through the solenoid valve. The time that the water continues to flow is determined by the values of C11 and the sum of the resistances of R18 and R19. Since R18 is a potentiometer, the flush time can be made adjustable from approximately 1 second to approximately 11 seconds. Other flush time can be obtained by suitably selecting the values of C11, R18 and R19. For a urinal, the action stops at this point.

When a toilet has been flushed, the siphon action of most toilets will leave the water level too low. In tank toilets the water level is refilled to the desired level by allowing a controlled low level flow to enter the overflow pipe, which recharges the bowl to its maximum level.

In a flush toilet the flow of water is controlled by a solenoid valve and the residual level of water left in the bowl is not controlled. In order to bring the residual level of water to the desired level, the flush solenoid is opened for a second time but for a much shorter period so that the bowl may be fully filled to the desired level but with too little water being supplied to initiate the siphon action. This second opening is delayed for a period of the order of five seconds from the termination of the flush action to permit the water flow of the flush to discharge fully and the system to stabilize.

The termination of the flushing period is caused by U4 pin 10 going to ground and cutting off the conduction of Q1. The signal from U4 pin is applied to a delay circuit consisting of C12 and R20. When U4 pin 10 goes to ground, a differentiated pulse is applied to U4 pin 3 and the output at U4 pin 4 will go to +5 volts. After a period of about 5 seconds, determined by the values of C12 and R20, the input to U4 pin will cause the output of U4 pin 4 to go to ground. At this time a negative going differentiated waveform will be applied to U4 pin 5. The time constant of this wave is determined by the values of C13, R22 and R21. R21 is a potentiometer and the time constant of the wave applied to U4 pin 5 is variable from about 0.7 seconds to about 1.4 seconds. The output at U4 pin 6 is applied to the gate of Q1 through D12. This output will open the solenoid valve a second time to refill the bowl to the desired level.

Although various embodiments including a preferred embodiment of the present invention have been described in the detailed description above, the description is not intended to limit the invention to the particular forms or embodiments disclosed herein, since those forms and embodiments will be recognized as illustrative rather than restrictive by those skilled in the art, who will further recognize that the invention is not so limited. The invention is declared rather, to cover all changes and modifications of the specific examples of the invention herein disclosed which do not constitute departures from the spirit and scope of the invention as defined in the appended claims.

What is claimed is:

1. A system for automatically flushing a commode in response to the presence of the user, said system comprising:

(a) light emitting means positioned for emitting a light beam of predetermined spectrum and frequency for illuminating a zone interceptable by said user;

(b) light sensor means juxtaposed to said light emitting means for detecting reflected light beams originating from said light emitting means and reflected back from said user; said light sensor means providing a low-level output signal in response to said reflected light beams;

(c) high-Q filter means tuned to the frequency of said light beams, receptive of said low-level output signal from said light sensor means, for filtering out unwanted signals and "noise" from said output signals;

(d) variable gain amplifier means for both amplifying the filtered signal from said high-Q filter and setting the sensitivity of said system;

(e) detector means receptive of an output signal from said amplifier means for rectifying or demodulating the same, to provide a DC output signal;

(f) circuit means responsive to said DC output signal, said circuit means including arming means for arming the circuit following the existence of said DC output signal to said circuit means for a predetermined period, and said circuit means further including means for thereupon generating a flow control signal for a second predetermined period following extinction of said DC output signal;

(g) means responsive to said flow control signal for opening a flush valve for a predetermined and adjustable period to flush said commode; and (h) means for reopening said flush valve upon completion of a predetermined delay following flushing, and to maintain said open position for a short preset interval, to enable the commode water level to be reestablished.

* * * * *